United States Patent [19]

Davis et al.

[11] Patent Number: 4,627,375

[45] Date of Patent: Dec. 9, 1986

[54] BOAT MOORING DEVICE

[76] Inventors: Roy F. Davis; William Murphy, both of 1223 Periwinkle Way, Sanibel, Fla. 33957

[21] Appl. No.: 707,961

[22] Filed: Mar. 4, 1985

[51] Int. Cl.[4] ..... B63B 21/00

[52] U.S. Cl. ..... 114/230; 114/219; 267/72

[58] Field of Search ..... 114/230, 219, 218, 343, 114/364, 381; 267/69, 70, 71, 72, 73, 74, 166

[56] References Cited

U.S. PATENT DOCUMENTS

| | | | |
|---|---|---|---|
| 198,275 | 12/1877 | Chase | 267/70 |
| 220,926 | 10/1879 | Luallen | 267/70 |
| 1,641,268 | 9/1927 | Halliburton | 267/69 |
| 3,084,517 | 4/1967 | Bell | 267/72 |
| 3,848,842 | 11/1974 | Jepson | 267/70 |
| 4,144,831 | 3/1979 | Heydolph | 114/230 |
| 4,488,511 | 12/1984 | Grassano | 267/70 |

*Primary Examiner*—Trygve M. Blix
*Assistant Examiner*—C. T. Bartz
*Attorney, Agent, or Firm*—Merrill N. Johnson

[57] ABSTRACT

A device to be used in pairs for mooring a boat alongside a dock, each device including an elongated cylinder preferably of polyvinyl chloride, a first piston for movement within the cylinder, a first piston rod preferably of stainless steel having one end affixed to the first piston and the other end designed to be removably attached to the boat, a first helical spring surrounding that portion of the first piston rod within the cylinder, a second piston with movement within the cylinder, a second piston rod preferably of stainless steel having one end attached to the second piston and its other end being removably attached to the dock, and a second helical spring floating within the cylinder between the first and second pistons.

5 Claims, 5 Drawing Figures

BOAT MOORING DEVICE

BACKGROUND AND SUMMARY OF THE INVENTION

Boaters, and particularly those operating in regions of high tides and turbulent waters, have always had difficulties in mooring their boat along side docks. A variety of line arrangements and accessories such as bumpers are known and used, but boats are often still damaged by shifting winds, tides and waves. In addition, most known mooring arrangements do not provide security against theft of the boat while moored along side a dock.

By use of a pair of unique mooring devices which we have invented, a boat can be quickly and securely moored at a dock without use of any lines, bumpers or similar gear conventionally used to moor a boat. Use of our mooring devices stabilize the boat, practically eliminating all but vertical movement of the boat. Thus the boat is prevented from bumping against the dock, getting caught beneath the dock at low tide and sinking when the tide rises, or breaking loose during rough weather. Our devices also include arrangements for locking the boat to the dock to deter theft.

Moreover, being preferably constructed of polyvinyl chloride piping, nylon and stainless steel, our mooring devices are impervious to sun, sea water, wind and other corrrosive elements. Fashioned like pistons, as the boat moves with the wind or turbulent water or rises or falls with the tide, our mooring devices work independently of each other and expand or contract to accommodate the boat's movement fore and aft. They are especially effective with sailboats which, because of their tall masts, have more movement from side to side.

We are aware that suggestions have been made in the past to use a piston arrangement to secure a boat to a dock. See, for example, U.S. Pat. Nos. 3,139,852 and 4,144,831. However, so far as we are aware such prior art devices have not been available on the market. To the contrary, our mooring devices have been constructed and tested in the Florida sun, salt waters and tides and found eminently satisfactory. Moreover, the construction of our mooring devices is uniquely different from known prior art devices and for this reason we believe function in a superior manner.

Briefly stated, our mooring device consists of an assembly which includes an elongated cylinder made of polyvinyl chloride pipe, two cylindrical nylon pistons within the cylinder, two stainless steel piston rods, each connected to one of the pistons and their other end connected to either the boat or the dock, and two helical coiled springs within the cylinder, one spring surrounding the piston rod whose end is connected to the boat and the other spring floating between the two pistons.

Preferably a nylon bushing designed to float within the cylinder surrounds the piston rod which connects to the boat. The bushing is located between the end of the spring surrounding the piston rod and the end of the cylinder.

To facilitate connecting our mooring device to the boat and to the dock, the outer end portion of the piston rod to be attached to the boat is bent at an angle of approximately 135° and the end of each piston rod includes a member of the same diameter as the piston rod but which lies at right angle to the axis of the piston rod. Each of these members has a smoothly rounded nose and a hole drilled diametrically across the member a short distance back of the nose.

To moor a boat to a dock using our mooring devices, two identical brackets are preferably mounted fore and aft along the gunwale of the boat and a complementary pair of brackets mounted on the dock. A cylindrical hole sized to accommodate the member on the end of each piston rod is drilled through an upright flange on each bracket. Thus, with the boat along side the dock, the ends of each piston rod are slipped through the holes in the brackets on the boat and on the dock and secured by a pin or the hasp of a padlock.

The boat is now secured to the dock and held in position away from collision with the dock and yet free to ride up and down with the tide or from side to side due to water turbulence or waves.

DETAILED DESCRIPTION OF THE PREFERRED EMBODIMENT

Figure 1:
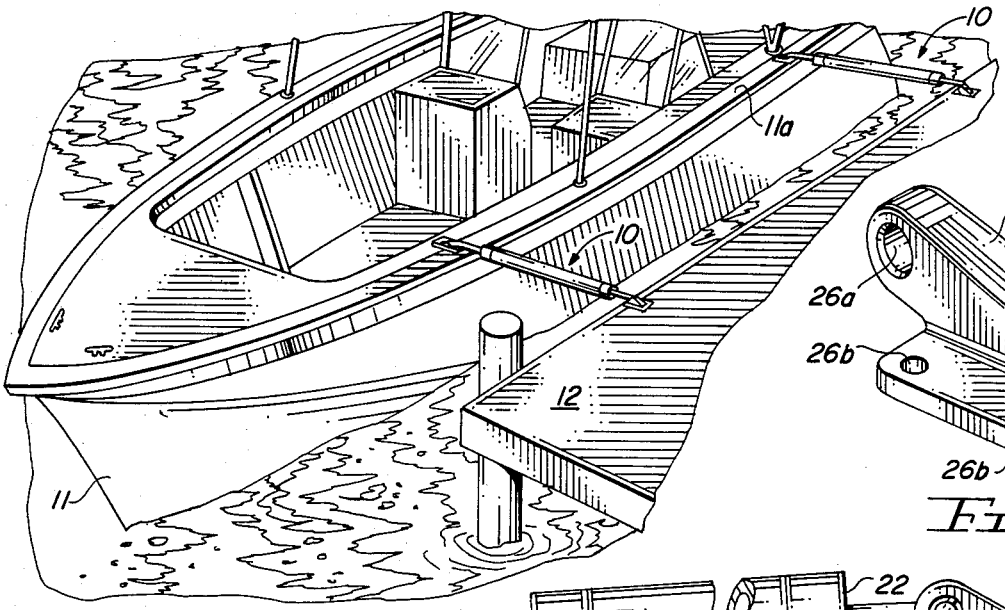
FIG. 1 is a perspective view of a boat moored along side a dock using a pair of our mooring devices called Mooring Masters TM.

Referring to the drawings, FIG. 1 illustrates a pair of our nautical mooring devices 10 being used to moor a boat 11 along side a dock 12.

Figure 5:
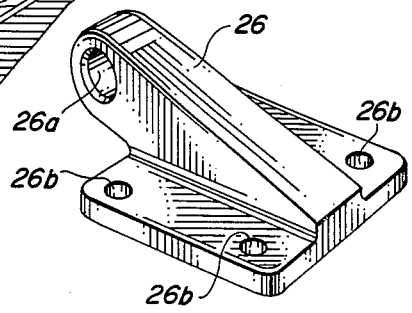
FIG. 5 is a perspective side view of one of the mounting brackets shown in FIG. 2.
Figure 2:
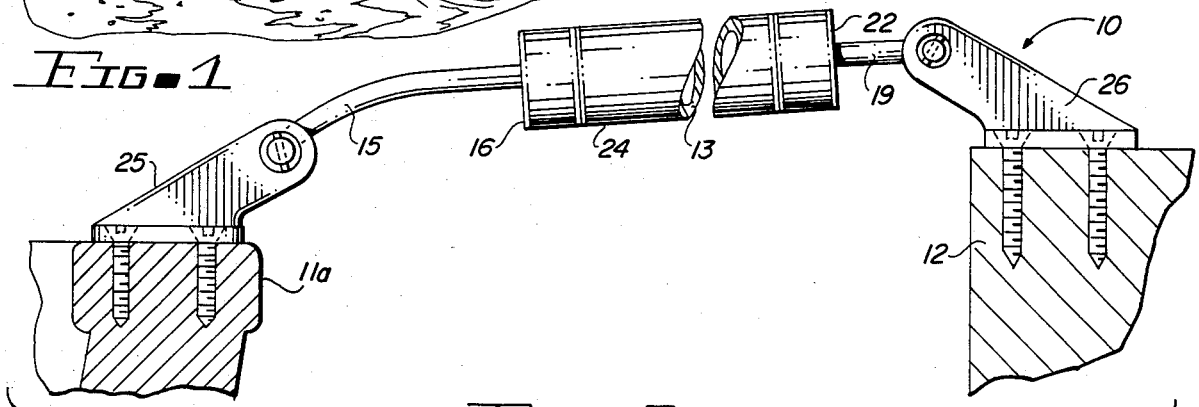
FIG. 2 is side view partially broken away showing one of our mooring devices attached to a boat and a dock.

A more detailed view of one of the mooring devices 10 illustrated in FIG. 1 is shown in FIG. 2. A bracket 25 is shown mounted on the gunwale **11*a* of the boat and a similar bracket 26 mounted on the dock 12. FIG. 5 illustrates the construction of brackets 25 and 26. Each bracket is preferably made of chrome plated brass to resist corrosion and consists of a flat horizontal plate and a vertical flange. A plurality of holes 26*b* permit the bracket to be screwed or bolted to either the boat or the dock. A horizontally drilled hole 26*a* in the upright flange is sized to permit hinged connection to the opposite ends of the piston rods 15 and 19** which form a part of our mooring device.

FIG. 2 shows the end of piston rod 15 hingedly connected to bracket 25 mounted on the boat's gunwale **11*a* and the end of piston rod 19 likewise connected to bracket 26 mounted on dock 12. The opposite ends of rods 15 and 19 are connected to separate pistons movable within cylinder 13. Cylinder 13 lies within a protective sheath 24 and is capped by end caps 16 and 22. Piston rods 15 and 19 are preferably made of stainless steel and cylinder 13, caps 16 and 19 and sleeve 24** of polyvinyl chloride to resist corrosion by sun, salt water and wind.

To facilitate connection of piston rod 15 to the boat, the end portion of rod 15 is preferably bent at an angle of approximately 135° to the axis of the piston rod.

It will be apparent that use of a pair of our mooring devices 10 will prevent any substantial fore or aft movement of boat 11 or any possibility of the boat coming in contact with dock 12. However, because of the unique hinged connections of the rods and the brackets, the boat will be free to move up and down with changes in the level of the water due to tides, waves or other water turbulence.

Figure 3:
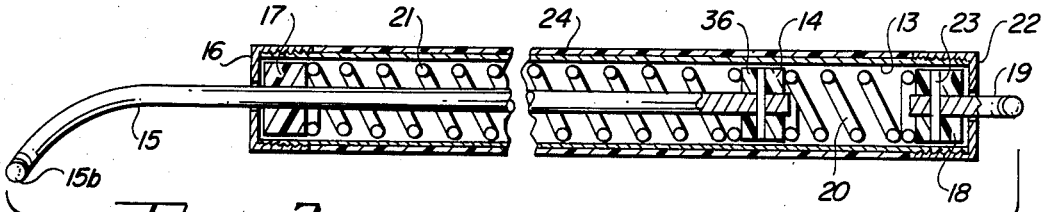
FIG. 3 is a cross-sectional view partially broken away showing the construction of a preferred form of our mooring device.
Figure 4:
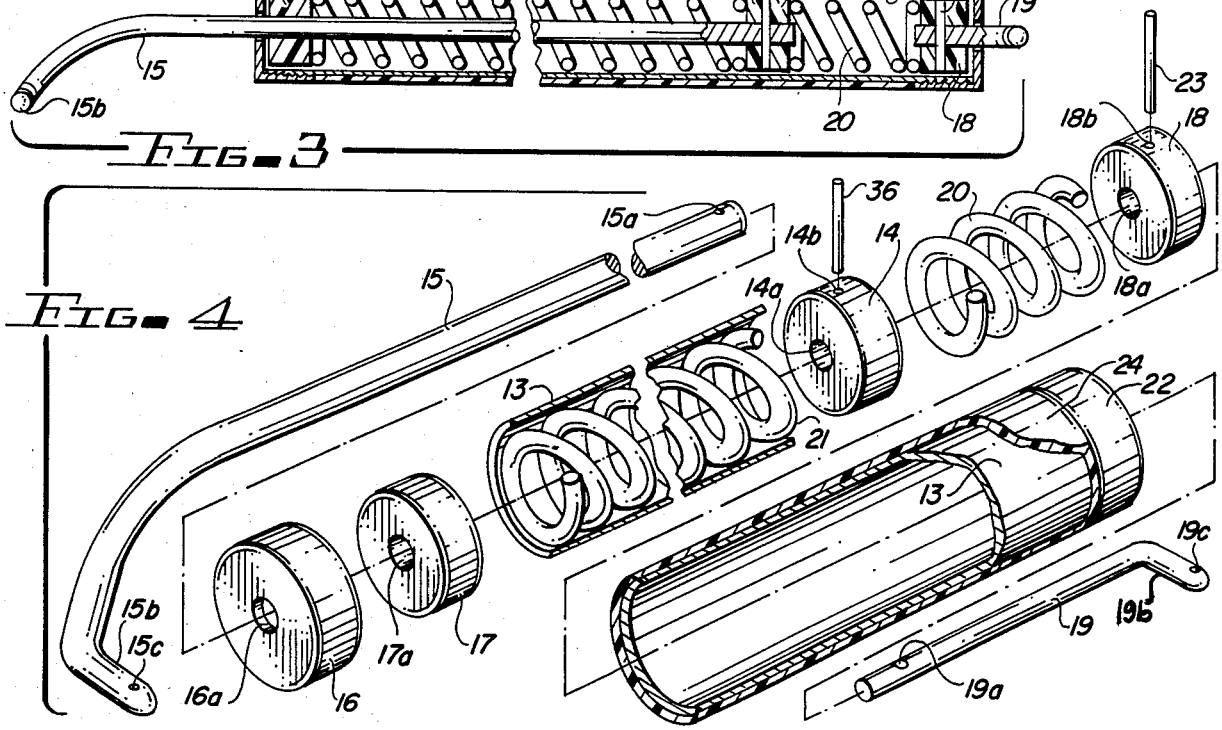
FIG. 4 is an exploded view of the mooring device shown in FIG. 3 which shows in greater detail the components of a preferred form of our mooring device.

Although alternative constructions and arrangements of the components of our invention will be apparent to those skilled in the art, the preferred embodiment is illustrated in FIGS. 3 and 4 of the drawings. Main cylinder 13 is preferably a 28 inch tube of 1½ inch diameter polyvinyl chloride (PVC) which will withstand pressures of 80 pounds per square inch. Its two ends are sealed by PVC end caps 16 and 22 having axial holes 16*a* and 22*a* respectively to permit slidable passage of the two piston rods 15 and 19 made of stainless steel. The major portion of cylinder 13 is covered by a protective sheath 24 also made of PVC and approximately 2/10ths of an inch in thickness.

Piston rod 15 is 28 inches and one end has a drilled hole 15*a* to connect the rod to a cylindrical nylon piston 14. Piston 14 is designed to slide within cylinder 13 and is connected to piston rod 15 by axial hole 14*a* and diametrically drilled hole 14*b* which accommodates a pin 36 passing through holes 14*b* and 15*a*.

To facilitate its hinged connection to a boat-mounted bracket, the final 4½ inches of rod 15 are bent at an angle of 135° to the axis of the piston rod and a member 15*b* of the same diameter as that of the rod, namely, ¾ of an inch, is attached at right angle to the end of the rod. Member 15*b* is 2½ inches long and ends in a rounded nose. A diametrically drilled hole 15*c* which is 5/16ths of an inch in diameter lies just back of the rounded nose of member 15*b*. The purpose of hole 15*c* is to accommodate a pin or a padlock to secure the mooring device to the boat.

A helically coiled spring 21 of stainless steel and 21 inches long surrounds that portion of piston rod 15 lying within cylinder 13 and a nylon bushing 17 having an axial hole 17*a* to accommodate rod 15 floats within cylinder 13 between end cap 16 and the end of spring 21.

The end of piston rod 19 lying within cylinder 13 contains a diametrically drilled hole 19*a* which along with pin 23 serves to connect the end of rod 19 to cylindrical nylon piston 18. Piston 18 is similar to piston 14 and is connected to the end of rod 19 by axial hole 18*a* and hole 18*b* which accommodates pin 23. Pistons 14 and 18 are separated by a helically coiled stainless steel spring 20 about 4½ inches long which floats between the two pistons.

Piston rod 19, like rod 15, is made of ¾ inch stainless steel rod and is 4½ inches in length. And like rod 15, a 2½ inch member 19*b* is attached at right angle to the end of rod 19. Member 19*b* is ¾ inch in diameter and 2½ inches long and ends in a rounded nose. A 5/16ths inch hole 15*c* back of its rounded nose is designed to accommodate a pin or padlock to secure mooring device 10 to a dock.

The preferred embodiment of mooring device 10 shown in FIGS. 3 and 4 has an overall length of 40 inches, but is capable under tension to expand to a length of 54 inches. This enables a pair of the devices to maintain a proper spacing between the dock and the boat despite wide variations in water level. And the hinged connections between the boat and the mooring devices and between the mooring devices and the dock allow free vertical movement of the boat in relation to the dock, while substantially restricting any fore and aft movement of the boat.

We have found that the preferred embodiment of our mooring device works admirably with both power boats and sailboats of from 15 to 45 foot length. For larger boats the design can be duplicated with somewhat larger components.

Having shown and described the preferred embodiment of our unique mooring device, changes and modifications of the structure and its essential components will be apparent to those skilled in the art and accordingly the spirit and scope of our inventions is limited only by the appended claims.

We claim:

1. A device for mooring a boat to a dock comprising
- an elongated cylinder having an axial hole in each of its two ends for slidable passage of a piston rod,
- a first piston designed to move back and forth along the axis of said cylinder,
- a first piston rod having one end affixed to said first piston and its other end designed to be removably attached to the boat,
- a first helical coiled spring surrounding that portion of the first piston rod lying within said cylinder,
- a second piston designed to move back and forth along the axis of said cylinder,
- a second piston rod having one end affixed to said second piston and its other end designed to be removably attached to the dock, and
- a second coiled helical spring floating within said cylinder between said first and second pistons.

2. A device according to claim 1 in which the end of each piston rod which lies outside said cylinder includes a member of the same diameter as the piston rod and which lies at right angle to the axis of the piston rod, said members being designed to slip into brackets mounted respectively on the boat and dock.

3. A device according to claim 1 in which the end portion of the first piston rod lying outside the cylinder is bent at an angle of approximately 135°.

4. A device according to claim 1 which includes a cylindrical bushing designed to float within the cylinder and surrounds the first piston rod between the end of the cylinder and the end of the first helical spring.

5. A device for mooring a boat to a dock comprising
- an elongated cylinder made of polyvinyl chloride having an axial hole in each of its two ends for slidable passage of a piston rod,
- a first piston made of thermoplastic material designed to move back and forth along the axis of said cylinder,
- a first piston rod made of stainless steel having one end affixed to said piston and its other end designed to be removably attached to the boat,
- a first helical coiled spring surrounding that portion of the first piston rod lying within said cylinder,
- a cylindrical bushing made of thermoplastic material designed to float within the cylinder and which surrounds the first piston rod between the end of the cylinder and the end of the first helical spring,
- a second piston made of thermoplastic material designed to move back and forth along the axis of said cylinder,
- a second piston rod made of stainless steel having one end affixed to said second piston and its other end designed to be removably attached to the dock, and
- a second helical coiled spring floating within said cylinder between said first and second pistons.

* * * * *